US007281787B2

(12) United States Patent
Robertson et al.

(10) Patent No.: US 7,281,787 B2
(45) Date of Patent: Oct. 16, 2007

(54) INTEGRATED INK CARTRIDGE PRIMER BULB

(75) Inventors: Robert Hunter Robertson, Cedar Park, TX (US); Jay William Gage, Pflugerville, TX (US); Wayne Iltis, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 369 days.

(21) Appl. No.: 11/173,270

(22) Filed: Jul. 1, 2005

(65) Prior Publication Data

US 2007/0002105 A1 Jan. 4, 2007

(51) Int. Cl.
*B41J 2/175* (2006.01)

(52) U.S. Cl. ..... 347/87; 347/86

(58) Field of Classification Search ..... 347/29, 347/35, 85, 86, 87, 92
See application file for complete search history.

(56) References Cited

U.S. PATENT DOCUMENTS 5,040,002 A * 8/1991 Pollacek et al. ..... 347/87
5,420,619 A 5/1995 Glassett et al. ..... 347/30
5,563,635 A 10/1996 Kneezel et al. ..... 347/12
5,936,650 A * 8/1999 Ouchida et al. ..... 347/89
6,533,403 B2 * 3/2003 Hou et al. ..... 347/86
6,837,921 B2 * 1/2005 Inoue et al. ..... 96/6
6,976,753 B2 * 12/2005 Kuwabara et al. ..... 347/86
7,159,974 B2 * 1/2007 Gray et al. ..... 347/86

* cited by examiner

*Primary Examiner*—Anh T. N. Vo
(74) *Attorney, Agent, or Firm*—Hamilton & Terrile LLP; Stephen A. Terrile

(57) ABSTRACT

An ink jet cartridge which includes an ink jet housing including a first valve and a primer portion coupled to the ink jet housing and covering the first valve is disclosed The primer portion includes a priming bulb and a second valve in the priming bulb, air flowing into the ink jet housing via the first bulb when the priming valve is actuated, air flowing into the priming portion via the second valve when the priming bulb is released.

18 Claims, 2 Drawing Sheets

INTEGRATED INK CARTRIDGE PRIMER BULB

BACKGROUND OF THE INVENTION

1. Field of the Invention

The present invention relates to the field of printers and more particularly printer ink cartridges.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems. One example of an information handing system is a printer.

One type of known printer is an ink jet printer. An ink jet printer includes one or more ink jet cartridges printer information onto a printing surface.

Known ink jet printers may present several problems when printing from an ink jet printer. For example, if the ink jet cartridges are exposed to air or are left in an incorrectly oriented position, the ink within the ink jet cartridges may flow away from the ink nozzles. Additionally, the ink nozzles within the ink jet cartridge are extremely small, and often become clogged with dried ink, dust and debris. Each of these problems can cause the printer to print poor quality output or to not print at all. A known solution to some or all of these problems is to prime or wick the cartridges. However, known methods for priming an ink jet cartridge are often not reliable, and often do not produce enough force to dislodge any debris.

Accordingly, it would be desirable to provide ink jet cartridges with a reliable and powerful mechanism for priming the ink jet cartridge.

SUMMARY OF THE INVENTION

In accordance with the present invention, an ink cartridge is set forth which includes an integrated priming bulb. A small flexible priming bulb is placed atop the printer cartridge housing. The bulb is mounted directly above a one way (i.e., omni-directional) valve to allow air from the bulb into the ink reservoir, but not allow the ink escape via the valve. A second one way valve allows air to enter the bulb. Whenever the priming bulb is pressed, air from the bulb is forced into the ink cartridge, thus exerting pressure on any debris in the ink nozzles and at the same time, priming all of the jets on the cartridge print head. The two one way valves prevent ink from escaping from the cartridge.

Such an ink cartridge allows a user to clean and prime the cartridge in a reliable manner with the addition advantage of not requiring any power to operate. In addition, this solution allows the user to prime the cartridge while it is in the printer, docked over the ink wells, or outside of the printer. If the cleaning is performed outside of the printer, the ink cartridge offers the additional advantage of keeping all ink and debris out of the printer internal mechanism. Finally, by priming the cartridge outside of the printer unit, the user has the option of visual feedback, via ink seeping from nozzles, on whether the nozzles are still blocked or if ink is unable to leave the nozzles for another reason.

More specifically, in one embodiment, the invention relates to an ink jet cartridge which includes an ink jet housing including a first valve and a primer portion coupled to the ink jet housing and covering the first valve. The primer portion includes a priming bulb and a second valve in the priming bulb, air flowing into the ink jet housing via the first valve when the priming valve is actuated, air flowing into the priming portion via the second valve when the priming bulb is released.

In another embodiment, the invention relates to an information handling system which includes a control system. The control system includes a processor, a printer housing, and an ink jet cartridge. The inkjet cartridge includes an ink jet housing including a first valve, a primer portion coupled to the ink jet housing and covering the first valve wherein the primer portion includes a priming bulb and a second valve in the priming bulb, air flowing into the ink jet housing via the first valve when the priming valve is actuated and air flowing into the priming portion via the second valve when the priming bulb is released.

In another embodiment, the invention relates to an apparatus for printing documents which includes a control system. The control system includes a processor, a housing, and an ink jet cartridge. The inkjet cartridge includes an ink jet housing including a first valve, a primer portion coupled to the ink jet housing and covering the first valve, the primer portion including priming bulb and a second valve in the priming bulb, air flowing into the ink jet housing via the first valve when the priming valve is actuated and air flowing into the priming portion via the second valve when the priming bulb is released.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
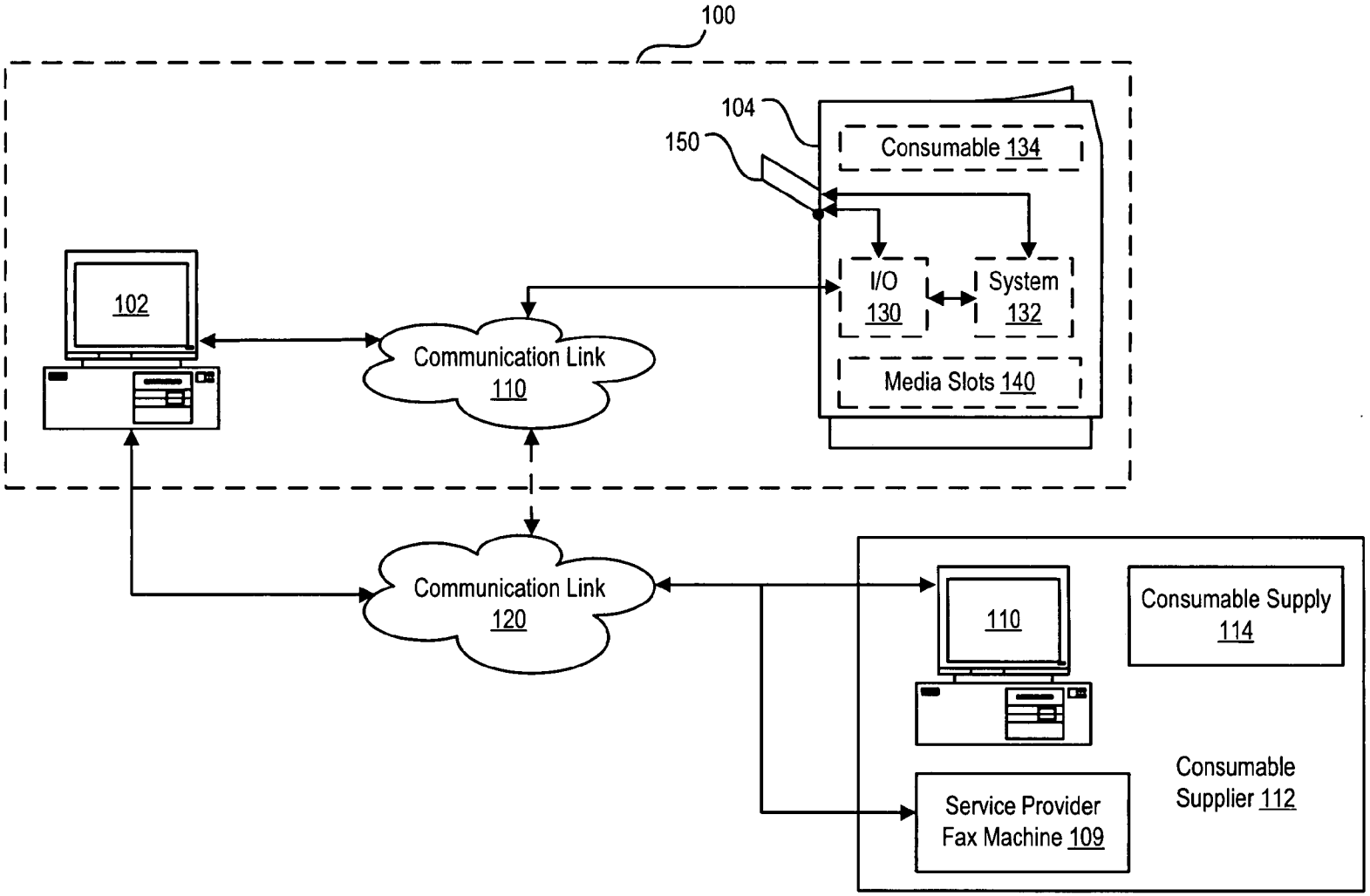
FIG. 1 shows a block diagram of an environment in which a printer with an ink cartridge having an integrated primer bulb is used.

Referring to FIG. 1, a block diagram of an environment in which a printer with an ink cartridge having an integrated primer bulb is used is shown. The environment includes an information handling system 102 (such as a computer system or a camera) and a printer 104, coupled via a communication link 110. The communication link 110 might be a printer cable, a telephone cable, a network connection or any other link which information is communicated with the printer 104. In one embodiment, the printer 104 is included within a multifunction device such as a combination printer fax machine. Other functions may also be included within the multifunction device such as a scan function and a copy function. Also, in one embodiment, the environment does not include a computer system 102.

The printer 104 is coupled to a second communication link 120. Thus, communication may occur between the printer 104 and anything coupled to the second communication link 120 such as a services provider fax machine 109. Additionally, the computer system 102 is also connected to another computer system (e.g., a services provider computer system) 110 via a second communication link 120. The second communication link 120 may be a telephone system or some other type of network, such as the Internet. In one embodiment, the fax machine 109 and the computer system 110 are owned and operated by a consumable supplier 112. In this example, the service provider 112 may provide service for the printer 104.

The printer 104 includes an input output (I/O) port 130, a control system 132 and at least two types of consumables 134. The I/O port 130 facilitates communications between the printer 104 and other devices connected to the communications link 110. The control system 132 provides the printer 104 with certain control functionality. The control system 132 includes a processor and memory coupled to the processor. The printer 104 may also include one or more media slots 140.

The consumables 134 represent any component in the printer 104 that is subject to depletion through use of the printer 104. For example, the consumable 134 may be a toner cartridge or an inkjet cartridge, etc. The consumables 134 include an ink cartridge having an integrated primer bulb. The service provider maintains a supply 114 of replacement consumables 134.

In operation, the computer system 102 generates a document in an electronic form and transmits the document (in the form of a print job) to the printer 104. The printer 104 receives the job via the I/O port 130 and prints the document. Additionally, when the printer 104 is part of a multifunction device, the printer 104 may receive and print information from the communication link 120 or from a scanned image when operating as a copier. Additionally, the printer 104 may receive and print information from any of its media slots 140.

Figure 2:
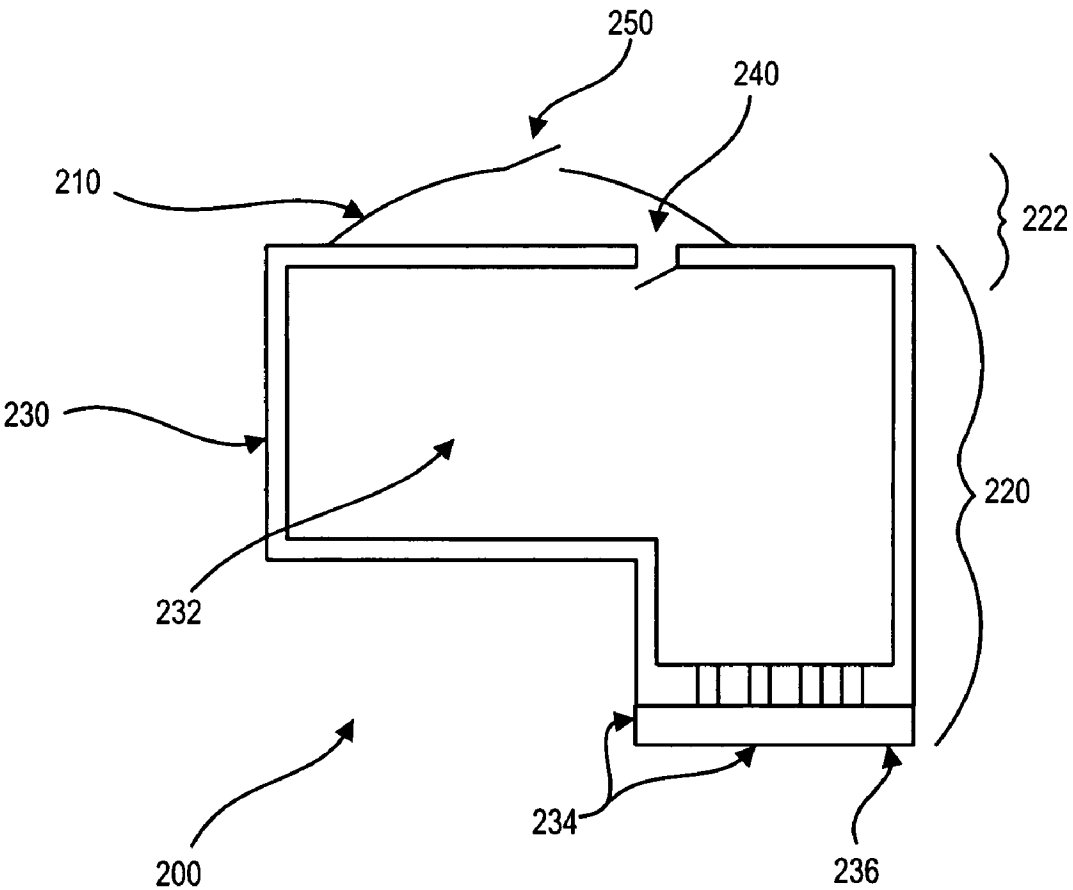
FIG. 2 shows a cross sectional view of an ink cartridge having an integrated primer bulb.

Referring to FIG. 2, a cross sectional view of an ink cartridge 200 having an integrated primer bulb 210 is shown. More specifically, the ink cartridge includes an ink portion 220 and a primer portion 222. The ink portion includes a cartridge housing 230 that defines an ink reservoir 232 for holding ink. The ink portion 220 also includes ink nozzles 234 and a cartridge print head 236 coupled to the housing via which ink held within the reservoir is transmitted to the printing surface under control of the control system 132.

The primer portion 222 includes the primer bulb 210 which is coupled to and integrated with the cartridge housing 230. The flexible priming bulb 210 is placed atop the printer cartridge housing 230. The priming bulb 210 is mounted directly above a one way (i.e., omni-directional) valve 240 which allows air from within the priming bulb 210 to flow into the ink reservoir 232, but not allow the ink escape via the valve 240. A second one way valve 250 allows air to enter the priming bulb 210. Whenever the priming bulb is actuated (i.e., compressed), air from the priming bulb 210 is forced into the housing 230 of the ink cartridge 200, thus exerting pressure on any debris in the ink nozzles 234 and at the same time, priming all of the jets on the cartridge print head 236. The two one way valves 240, 250 prevent ink from escaping from the cartridge.

Such an ink cartridge 200 allows a user to clean and prime the cartridge 200 in a reliable manner with the addition advantage of not requiring any power to operate. In addition, this ink cartridge 200 allows the user to prime the cartridge 200 while it is in the printer 104, docked over the ink wells, or outside of the printer 104. If the cleaning is performed outside of the printer 104, the ink cartridge offers the additional advantage of keeping all ink and debris out of the printer internal mechanism. Finally, by priming the cartridge 200 outside of the printer 104, the user has the option of visual feedback, via ink seeping from nozzles, on whether the nozzles are still blocked or if ink is unable to leave the nozzles for another reason.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

For example, the above-discussed embodiments include software modules that perform certain tasks. The software modules discussed herein may include script, batch, or other executable files. The software modules may be stored on a machine-readable or computer-readable storage medium such as a disk drive. Storage devices used for storing software modules in accordance with an embodiment of the invention may be magnetic floppy disks, hard disks, or optical discs such as CD-ROMs or CD-Rs, for example. A storage device used for storing firmware or hardware modules in accordance with an embodiment of the invention may also include a semiconductor-based memory, which may be permanently, removably or remotely coupled to a microprocessor/memory system. Thus, the modules may be stored within a computer system memory to configure the computer system to perform the functions of the module. Other new and various types of computer-readable storage media may be used to store the modules discussed herein. Additionally, those skilled in the art will recognize that the separation of functionality into modules is for illustrative purposes. Alternative embodiments may merge the functionality of multiple modules into a single module or may impose an alternate decomposition of functionality of modules. For example, a software module for calling sub-modules may be decomposed so that each sub-module performs its function and passes control directly to another sub-module.

Consequently, the invention is intended to be limited only by the spirit and scope of the appended claims, giving full cognizance to equivalents in all respects.

What is claimed is:

1. An ink jet cartridge comprising:

an ink jet housing including a first valve;

a primer portion coupled to the ink jet housing and covering the first valve, the primer portion including priming bulb and a second valve in the priming bulb, air flowing into the ink jet housing via the first valve when the priming bulb is actuated, air flowing into the priming bulb via the second valve when the priming bulb is released.

2. The ink jet cartridge of claim 1 further comprising:

ink nozzles coupled to the ink jet housing, pressure being exerted on the ink nozzles when air flows into the ink jet housing.

3. The ink jet cartridge of claim 1 further comprising:

a cartridge print head coupled to the ink nozzles, pressure being exerted on the cartridge print head when air flows into the ink jet housing.

4. The ink jet cartridge of claim 1 wherein:

the first valve is omni-directional.

5. The ink jet cartridge of claim 1 wherein:

the second valve is omni-directional.

6. The ink jet cartridge of claim 1 wherein:

the primer bulb is integrated with the cartridge housing.

7. An information handling system comprising:

a control system, the control system including a processor;

a printer housing; and, an ink jet cartridge, the ink jet cartridge including an ink jet housing including a first valve;

a primer portion coupled to the ink jet housing and covering the first valve, the primer portion including a priming bulb and a second valve in the priming bulb, air flowing into the inkjet housing via the first valve when the priming bulb is actuated, air flowing into the priming bulb via the second valve when the priming bulb is released.

8. The information handling system of claim 7 wherein the ink jet cartridge further comprises:

ink nozzles coupled to the ink jet housing, a pressure being exerted on the ink nozzles when air flows into the ink jet housing.

9. The information handling system of claim 7 wherein the inkjet cartridge further comprises:

a cartridge print head coupled to the ink nozzles, pressure being exerted on the cartridge print head when air flows into the ink jet housing.

10. The information handling system of claim 7 wherein:

the first valve is omni-directional.

11. The information handling system of claim 7 wherein:

the second valve is omni-directional.

12. The information handling system of claim 7 wherein:

the primer bulb is integrated with the cartridge housing.

13. An apparatus for printing documents comprising:

a control system, the control system including a processor;

a housing; and, an ink jet cartridge, the ink jet cartridge including an ink jet housing including a first valve;

a primer portion coupled to the ink jet housing and covering the first valve, the primer portion including a priming bulb and a second valve in the priming bulb, air flowing into the ink jet housing via the first valve when the priming bulb is actuated, air flowing into the priming bulb via the second valve when the priming bulb is released.

14. The apparatus of claim 13 further comprising:

ink nozzles coupled to the ink jet housing, a pressure being exerted on the ink nozzles when air flows into the ink jet housing.

15. The apparatus of claim 13 further comprising:

a cartridge print head coupled to the ink nozzles, pressure being exerted on the cartridge print head when air flows into the ink jet housing.

16. The apparatus of claim 13 wherein:

the first valve is omni-directional.

17. The apparatus of claim 13 wherein:

the second valve is omni-directional.

18. The apparatus of claim 13 wherein:

the primer bulb is integrated with the cartridge housing.

* * * * *